US006262383B1

(12) United States Patent
Nishikawa

(10) Patent No.: US 6,262,383 B1
(45) Date of Patent: Jul. 17, 2001

(54) TACT SWITCH AND ITS MOVABLE CONTACT PIECE

(75) Inventor: Kikuyoshi Nishikawa, Yokohama (JP)

(73) Assignee: Sagami Electric Company, Ltd., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/626,446

(22) Filed: Jul. 26, 2000

(30) Foreign Application Priority Data

Feb. 25, 2000 (JP) ..... 12-049383
Mar. 2, 2000 (JP) ..... 12-056950

(51) Int. Cl.[7] ..... H01K 1/10
(52) U.S. Cl. ..... 200/406; 200/533; 200/551
(58) Field of Search ..... 200/16 R–16 D, 200/405–409, 449, 520, 521, 522, 533, 341, 275, 516

(56) References Cited

U.S. PATENT DOCUMENTS 4,426,559 * 1/1984 Kondo et al. ..... 200/67 DB
4,588,877 * 5/1986 Mizuta et al. ..... 200/67 DB
5,140,116 * 8/1992 Schmitt-Walter ..... 200/314
5,660,272 * 8/1997 Janniere et al. ..... 200/517
6,018,132 * 1/2000 Chen ..... 200/406
6,114,644 * 9/2000 Nishikawa ..... 200/406

* cited by examiner

*Primary Examiner*—Michael Friedhofer
(74) *Attorney, Agent, or Firm*—Connolly Bove Lodge & Hutz LLP

(57) ABSTRACT

In a tact switch in which pressing operation on an operating portion of an actuator member will cause the forward end portion of the actuator member to be pushed toward the bottom surface of a housing while being guided by an inclined surface so that the forward end portion (flexible portion) of the actuator member is flexed to press down on the marginal regions of a movable contact piece whereby the curved section of the movable contact piece is flipped over, a cam defining the inclined surface is provided separately from the housing. The movable contact piece, the actuator member, the cam and a top lid may be assembled together simply by stacking them sequentially from above onto the housing.

8 Claims, 10 Drawing Sheets

TACT SWITCH AND ITS MOVABLE CONTACT PIECE

BACKGROUND OF THE INVENTION

This invention relates to a tact switch and its movable contact piece, and particularly to a tact switch in which the flipping-over or reversing action of the cup-shaped curved portion of the movable contact piece will cause the contact section disposed around the periphery of the cup-shaped portion to come into contact with a plurality of fixed contact plates to establish electrical conduction between the fixed contact plates, and the movable contact piece.

U.S. patent application Ser. No. 09/414,067 (filed on Oct. 7, 1999) assigned to the same assignee as the present application proposes a tact switch of the type described herein having external appearances as shown in FIGS. 1A, 1B and 1C. This tact switch comprises a housing, a top lid, an actuator member and a movable contact piece. FIG. 2 is an exploded, perspective view of the tact switch. The construction of the various parts of the tact switch will first be described with reference to FIG. 2.

The housing 11 is made from a synthetic resin material in the form of a box having an open top. Exposed within the box are the inner end portions of four insert-molded fixed contact plates 13 one at each of the four corners of the bottom surface of the box surrounded by side walls 12. Formed in the center of the bottom surface is a circular pedestal 14 having a stud-like protrusion 15 upstanding therefrom. The other end portion of each of the fixed contact plates 13 extends out of the housing 11 and terminates in a terminal 13*a*.

One pair of the side walls 12 defining major sides of the housing 11 has notches 16 and 17, respectively cut down from the top edges of the side walls in the middle thereof. One 16 of the notches further has a lower recess 18 formed in the center thereof. The bottom surface of the recess 18 is arranged to lie at the same elevation as the bottom surface of the notch 17 in the other side wall 12.

On the other hand, the other pair of the side walls 12 defining minor sides of the housing 11 has notches 19 cut down from the top edges of the side walls and diverging or increasing in width downwardly toward the bottom surface as shown. Each of the notches 19 has one vertically extending inner side surface 19*a* and the opposed downwardly outwardly inclined or tapered inner side surface 19*b*.

A stepped portion or ledge 21 extends from the vertical side surface 19*a* of one of the notches 19 along the interior of that side wall 12 in which the notch 16 is formed to the vertical side surface 19*a* of the other notch 19, with the bottom surface of the stepped portion 21 being flush with the bottom surfaces of the notches 19 and somewhat lower than the bottom surface of the recess 18.

The side walls 12 in which the notches 16, 17 are formed, respectively have engagement lugs 22 protruding from the outer surfaces thereof at the upper corners, while the other side walls 12 in which the notches 19 are formed have engagement recesses 23 formed in the outer surfaces thereof in the center adjacent the top edges.

The top lid 24 adapted to be mounted on the top of the housing 11 to close the open top of the housing 11 is made of metal and comprise a rectangular top plate 25 having engagement flaps 26 extending and folded down from the opposed minor sides thereof and L-shaped latch tabs 27 extending from the opposed major sides adjacent opposite ends thereof.

The movable contact piece 28 is made in the shape of a cup having small marginal flat portions from a spring material such as a phosphor bronze plate. In the example illustrated, it is made from a generally rectangular sheet so as to define a curved section 29 with longitudinal opposite end portions of the sheet left. The curved section 29 is formed in the center with a positioning hole 31. In addition, the movable contact piece 28 has a notch 32 formed in each of the opposite minor sides in the middle thereof to define contact portions 33 at the opposite ends of the minor side.

The actuator member 34 for press-actuating the movable contact piece 28 is made of a synthetic resin material and comprises two actuating bars 35, a guide bar 36 extending between and parallel to the two actuating bars 35 and an operating portion 37 connecting the two actuating bars 35 and the guide bar 36 together on one ends thereof.

The guide bar 36 terminates in a forward broadened end portion as shown. Each of the actuating bars 35 has an actuating protrusion 38 formed on its lower surface. It is to be 25 noted that the guide bar 36 has a thickness slightly greater than the actuating bars 35.

The assembly of the tact switch is carried out by assembling the movable contact piece 28 and the actuator member 34 sequentially into the housing 11 and closing it by the top lid 24. During this operation of assembly, the movable contact piece 28 is assembled with the curved section 29 projecting downwardly convexly with the apex of thereof resting on the pedestal 14 and the positioning hole 31 fitted over the protrusion 15 for positioning the contact piece.

FIG. 3 illustrates the movable contact piece 28 assembled in the housing. FIG. 4A illustrates the actuator member 34 assembled from above onto the sub-assembly shown in FIG. 3. It is seen that the operating portion 37 of the actuator member 34 is located outside of the housing 11 with the outer portions of the forward ends of the two actuating bars 35 slightly dipped under the inclined surfaces 19*b* of the housing 11.

The root portions (toward the joints to the operating portion 37) of the two actuating bars 35 and the guide bar 36 are located over the notches 16 and the recess 18, respectively of the housing 11. That is, the actuating bars 35 and the guide bar 36 are inserted into the housing 11 through the notches 16 and the recess 18. The forward end of the guide bar 36 is guided in the notch 17.

In this state as shown in FIG. 4A, the actuating protrusions 38 provided on the forward ends of the actuating bars 35 lying on the marginal portions of the movable contact piece 28 in slight resilient contact therewith.

The securement of the top lid 24 to the housing 11 is effected by engaging the L-shaped latch tabs 27 with the respective engagement lugs 22. In doing so, the two engagement flaps 26 are fitted into the respective engagement recesses 23 whereby the assembly of the tact switch as shown in FIGS. 1A, 1B and 1C is completed.

With the tact switch constructed as described above, when the operating portion 37 is pushed inwardly parallel to the bottom surface of the housing 11, the forward end portions of the two actuating bars 35 are depressed downwardly toward the bottom surface of the housing 11 as they are guided by the inclined surfaces 19*b*. Specifically, the actuating bars 35 are flexed as shown in FIG. 5B to cause the actuating protrusions 38 to press down on the marginal portions of the movable contact piece 28.

This pressing operation causes the movable contact piece to be inverted or flipped over in its convexity-concavity orientation to thereby bring its contact portions 33 into contact with the corresponding fixed contact plates 13. This contact brings the four fixed contact plates 13 into conduction with each other to turn the switch on. It should be noted that FIG. 4B illustrated the operating portion 37 as being pushed inwardly with the top lid removed while FIG. 6 illustrates the movable contact piece 28 in its reversed state in the broken lines.

When the pushing operation on the operating portion 37 is released, the movable contact piece 28 is flipped over back to its original curved position due to its elastic restoring force to turn the switch off while at the same time the movable contact actuator member 34 is forced out of the housing 11 whereby the operating portion 37 is restored to its original position, that is, to the non-operative state shown in FIG. 5A.

It has been found out, however, that the tact switch having the construction as discussed above have some problems in attempting the automation of assembly.

Specifically, although the movable contact piece 28 and the top lid 24 may be assembled by stacking (dropping) and pushing them one on another from above, the actuator member 34 cannot be assembled simply by depositing on the underlying component from above, since it is required to dip the forward ends of the actuating bars 35 under the inclined surfaces 19*b* of the housing 11. In other words, the actuator member 34 need be inserted obliquely in the direction of inclination of the inclined surfaces 19*b* into the housing 11 for assembly. This has posed difficulties in atomizing the assembly of the switch.

In addition, it has been found that the movable contact piece 28 having the construction as described above and assembled as such in the switch has also a problem in the reliability in electrical contact with the fixed contact plates 13 in that it can cause an increase in the contact resistance and even the worst malfunction (failure to establish the switch-on state).

This is due to the configuration of the contact portions 33 provided around the marginal portions of the movable contact piece 28. More specifically, the contact portions 33 are configured to terminate in essentially linear forward ends to make line contact with the fixed contact plates 13, resulting possibly in failure to provide adequate contacting pressure. To be worse, variations in the geometry and/or assembly of the switch components can possibly cause substantial portions of linear forward ends of the contact portions 33 to lift off the fixed contact plates 13 when the witch is brought into its on-position.

SUMMARY OF THE INVENTION

In view of the foregoing problems, a primary object of this invention is to provide an improved tact switch of the type described which is configured to facilitate the automation of assembly, and hence allow for less expensive manufacture.

Another object of this invention is to provide an improved movable contact piece for use with such tact switch constructed to provide superior contacting reliability.

According to a first aspect of this invention, a tact switch is provided which comprises a box-like housing made of a resin material having an open top, and a plurality of fixed contact plates disposed on the bottom surface thereof within the box; a movable contact piece comprising a cup-shaped curved section and contact portions provided on the marginal regions of the curved section, the curved section normally projecting downwardly convexly and resting on the bottom surface of the housing; an actuator member having one end portion overlying the marginal regions of the movable contact piece and the other end portion extending out through a notch formed in a side wall of the housing and terminating in an exterior operating portion adapted to be operatively pushed into the housing in a direction parallel to the bottom surface; a cam positioned forward of the actuating direction of the actuator member within the housing and having an inclined surface adapted to abut with a forward end portion on one end of the actuator member; and a top lid closing the open top of the housing, the arrangement being such that the pushing operation will cause the forward end of the actuator member to be pushed toward the bottom surface while being guided by the inclined surface, so that the forward end portion of the actuator member is flexed to press down on the marginal regions of the movable contact piece whereby the curved section of the movable contact piece is inverted in its convexity-concavity orientation to thereby bring the contact portions into contact with the corresponding fixed contact plates.

According to a second aspect of this invention, a movable contact piece for use with a switch is provided which comprises a cup-shaped curved section and contact portions provided on the marginal regions of the curved section, the movable contact piece being configured such that when the marginal regions of the curved section are pressed on, the curved section is inverted in its convexity-concavity orientation to thereby bring the marginal regions into contact with opponent fixed contact plates and when the pressing action on the marginal regions is released, the movable contact piece is elastically restored to its original curved position, characterized in that the movable contact piece is provided on its marginal regions with contact protuberances for contact with the fixed contact plates.

Preferably, the movable contact piece may be provided with two contact protrusions for each of the fixed contact plates.

DETAILED DESCRIPTION OF PREFERRED EMBODIMENTS OF THE INVENTION

Figure 1A:
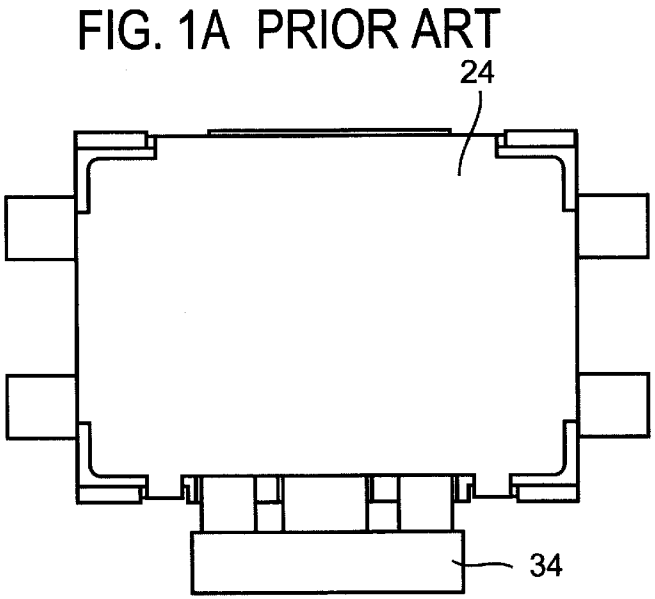
FIG. 1A PRIOR ART
FIG. 1A is a plan view the tact switch disclosed in the aforesaid prior patent application.
Figure 1B:
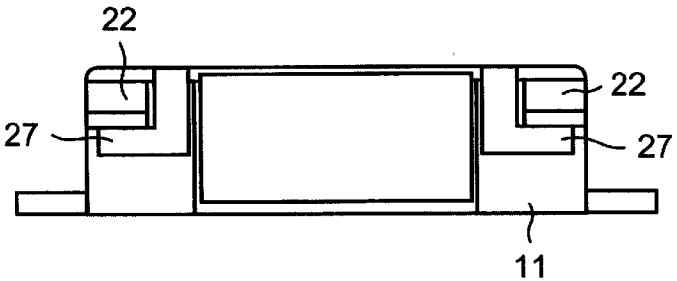
FIG. 1B PRIOR ART
FIG. 1B is a front view of the tact switch of FIG. 1A.
Figure 1C:
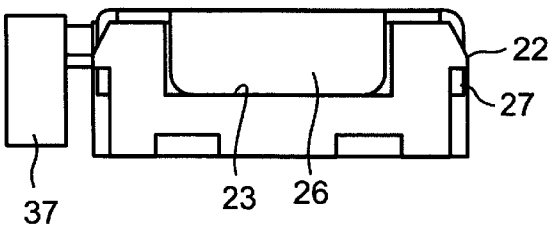
FIG. 1C PRIOR ART
FIG. 1C is a side view of the tact switch of FIG. 1A.

The construction of the invention will be described with reference to the embodiments illustrated in the drawings. It is to be understood that the elements corresponding to those shown in FIG. 2 are indicated by like reference numerals and detailed description of them will be omitted.

Figure 7A:
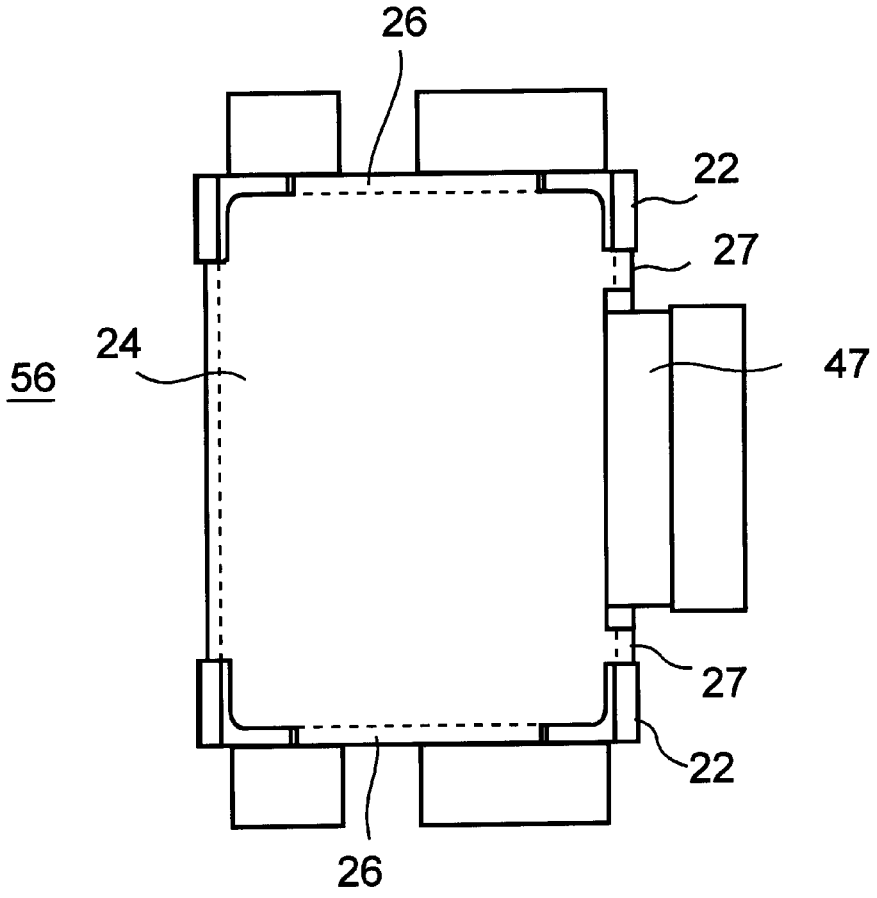
FIG. 7A is a plan view illustrating one embodiment of this invention.
Figure 7B:
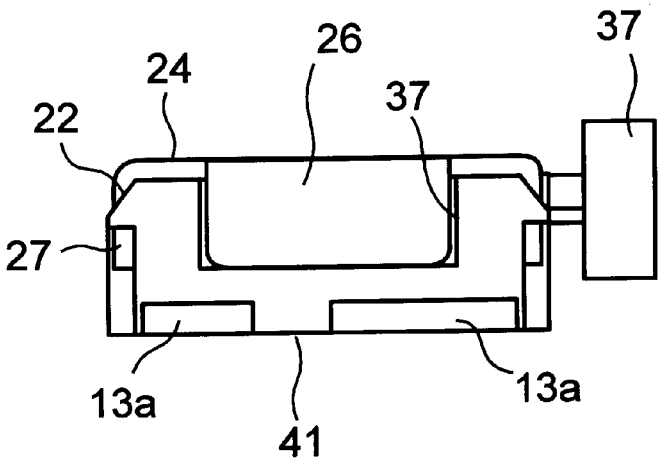
FIG. 7B is a front view of the tact switch of FIG. 7A.
Figure 8A:
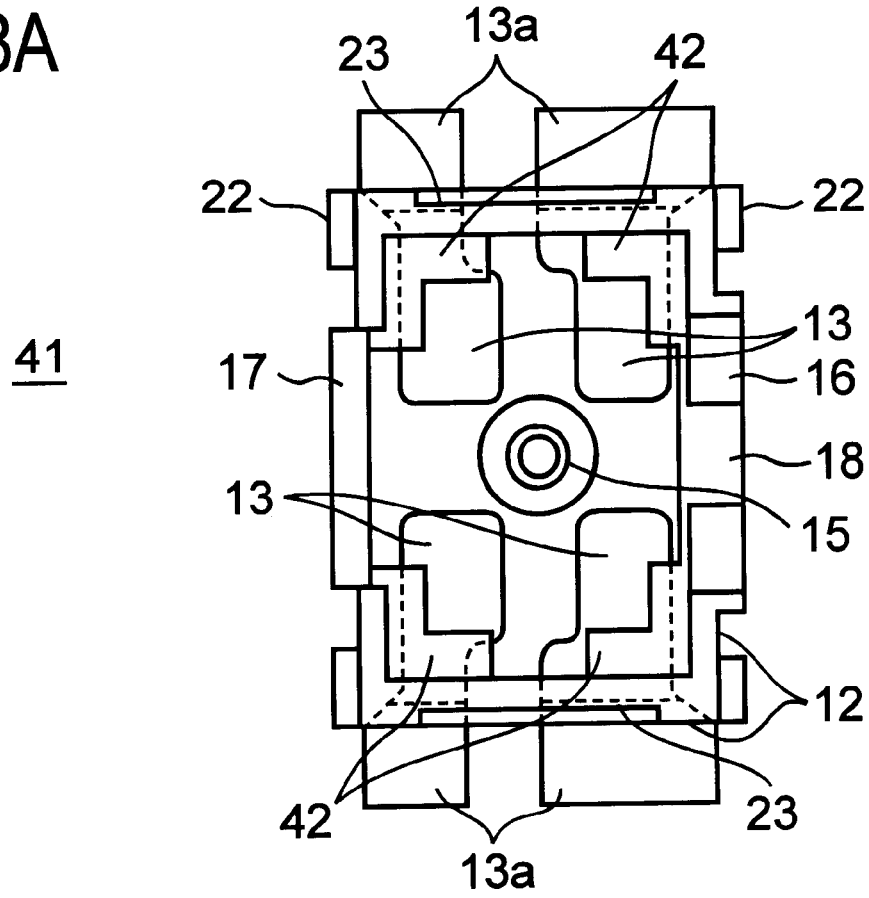
FIG. 8A is a plan view illustrating the housing of the tact switch of FIG. 7.
Figure 8B:
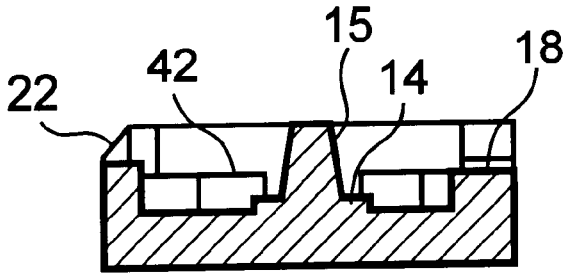
FIG. 8B is a cross-sectional view of the housing shown in FIG. 8A.
Figure 9A:
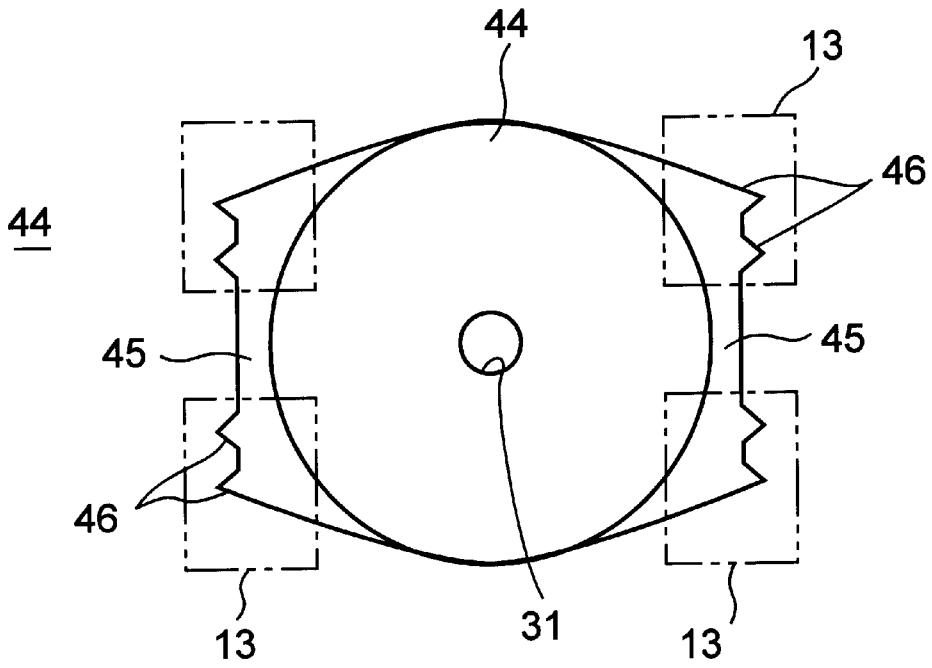
FIG. 9A is a plan view illustrating one embodiment of the movable contact piece.
Figure 9B:
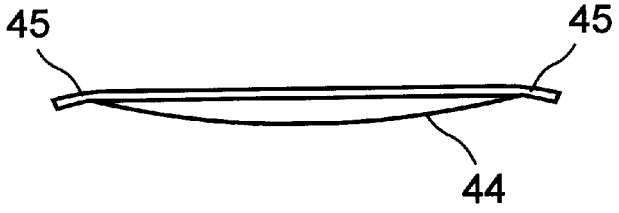
FIG. 9B is a front view of the movable contact piece of FIG. 9A.
Figure 9C:
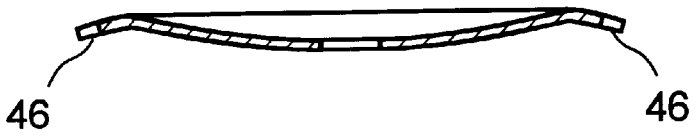
FIG. 9C is a cross-sectional view of the movable contact piece of FIG. 9A.
Figure 10A:
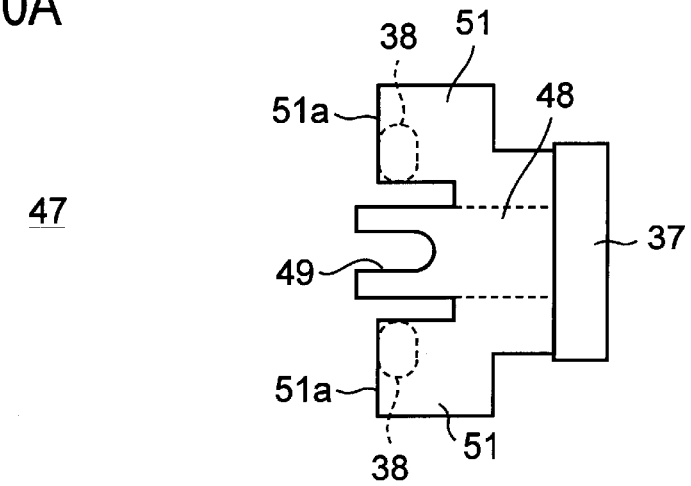
FIG. 10A is a plan view illustrating the actuator member of the tact switch of FIG. 7.
Figure 10B:
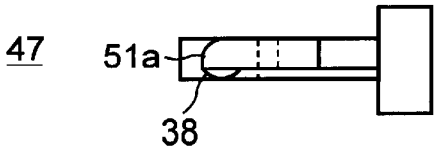
FIG. 10B is a front view of the actuator member of FIG. 10A.
Figure 11A:
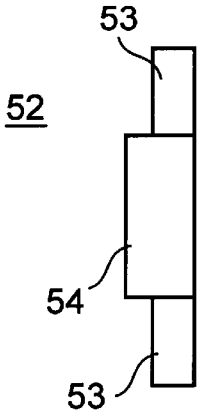
FIG. 11A is the left-side view illustrating a cam in the tact switch of FIG. 7.
Figure 11B:
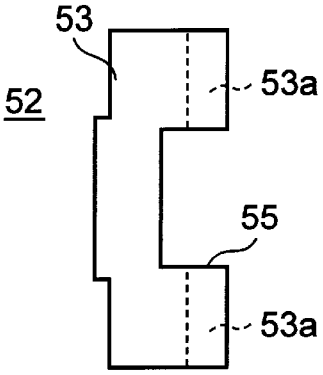
FIG. 11B is a plant view of the cam shown in FIG. 11A.
Figure 11C:
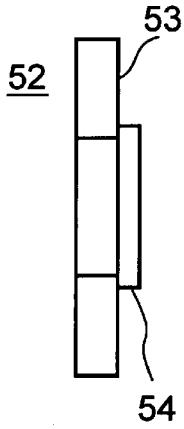
FIG. 11C is the right-side view of the cam shown in FIG. 11A.

FIGS. 7A and 7B show the exterior construction of one embodiment of the tact switch according to this invention, FIGS. 8A and 8B the construction of the housing of the tact switch, FIGS. 9A, 9B and 9C the construction of the movable contact piece, FIG. 10A and FIG. 10B the construction of the actuator member, and FIGS. 11A and FIG. 11B the construction of the cam. The constructions of the various components will first be described.

Figure 2:
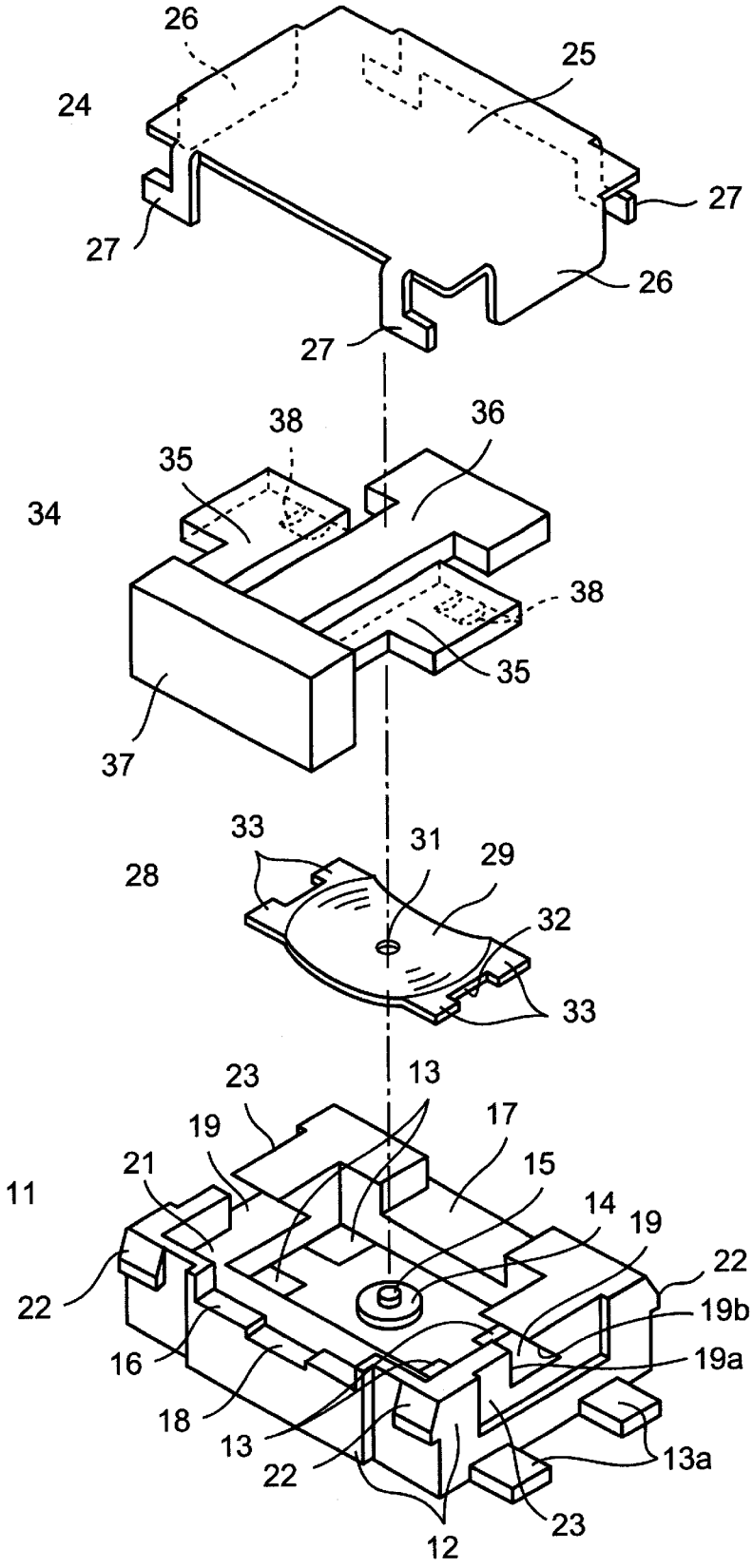
FIG. 2 PRIOR ART
FIG. 2 is an exploded perspective view of the tact switch of FIG. 1.
Figure 3:
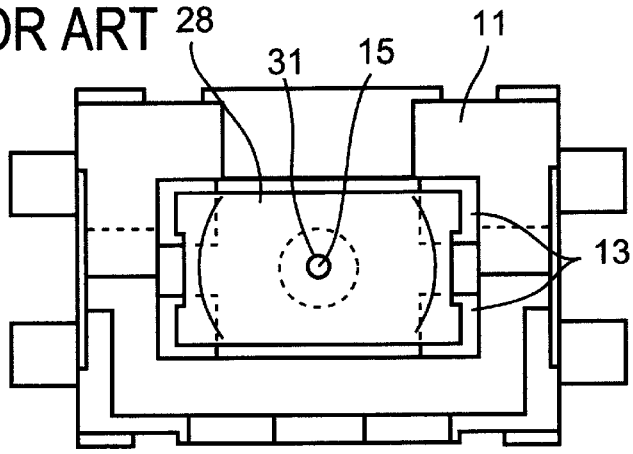
FIG. 3 PRIOR ART
FIG. 3 is a plan view showing the tact switch of FIG. 1 having a movable contact piece assembled into the housing thereof.
Figure 4A:
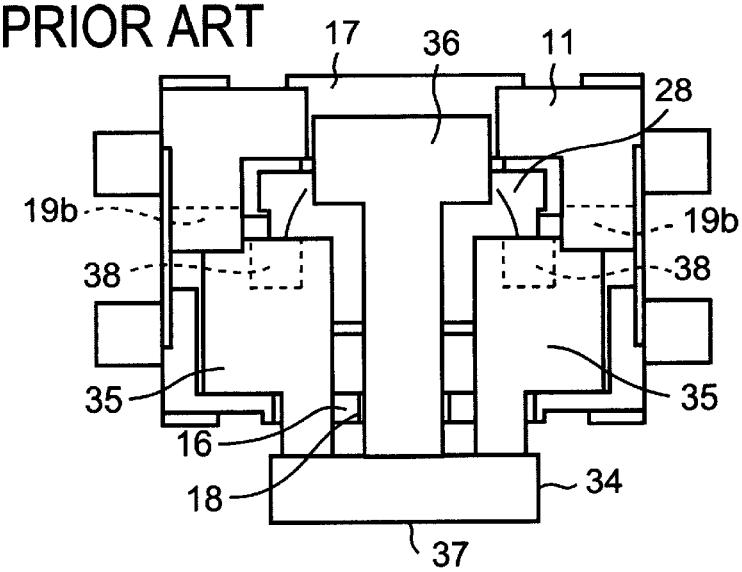
FIG. 4A PRIOR ART
FIG. 4A is a plan view showing the tact switch of FIG. 1 further having an actuator member assembled into the housing thereof.
Figure 4B:
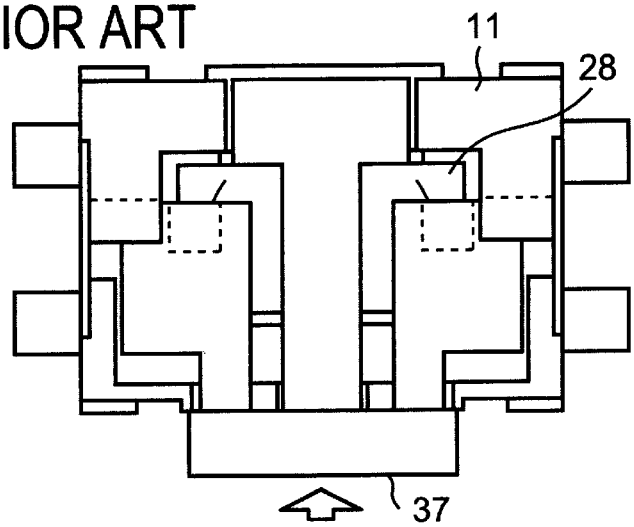
FIG. 4B PRIOR ART
FIG. 4B is a plan view showing the operating portion pushed into the housing with the top lid removed.
Figure 5A:
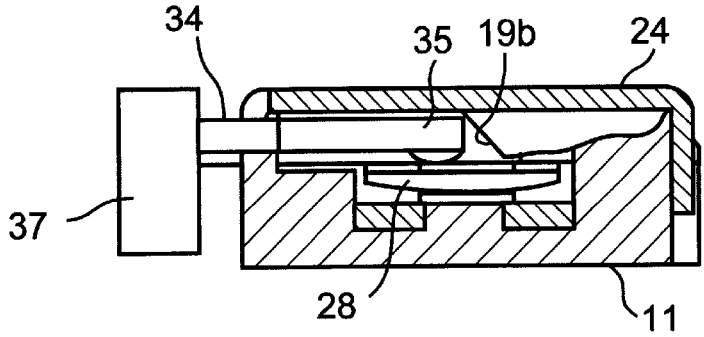
FIG. 5A PRIOR ART
FIG. 5A is a side view, partly in cross-section, of the tact switch of FIG. 1.
Figure 5B:
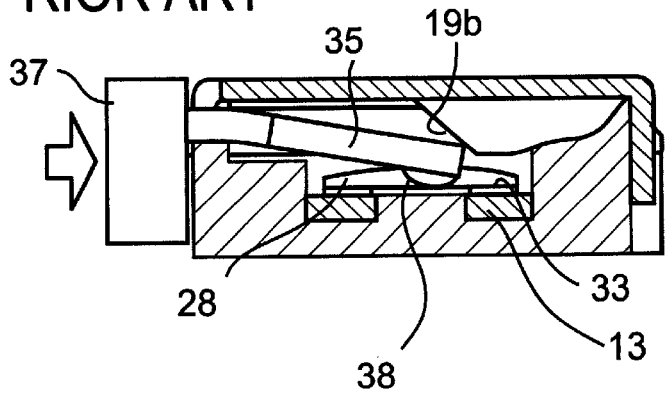
FIG. 5B PRIOR ART
FIG. 5B is a side view, partly in cross-section, of the tact switch with the operating portion pushed into the housing.
Figure 6:
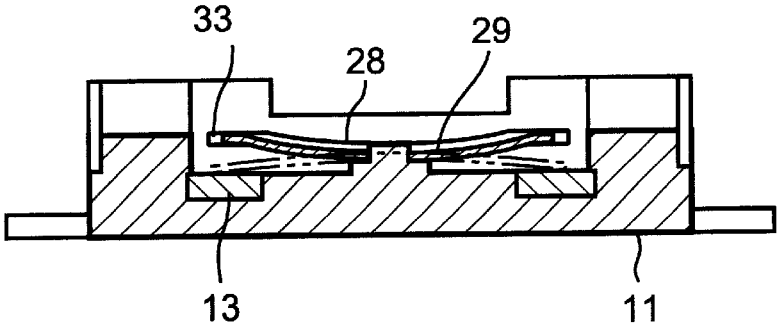
FIG. 6 PRIOR ART
FIG. 6 is a side view, partly in cross-section, of the tact switch of FIG. 1 illustrating how the movable contact piece is inverted.

The housing 41 of the switch is made of a synthetic resin material and as shown in FIGS. 8A and 8B, it is in the form of a box like the housing 11 shown in FIG. 2 having an open top and four fixed contact plates 13 disposed within the housing 41 on the bottom surface thereof. Formed on the bottom surface of the housing at each of the four corners thereof is a seat 42 or bench which is L-shaped in plan in this example. The top surfaces of these seats 42 are formed to lie at the same elevation as the bottom surface of the recess 18 formed in the notch 16. The fixed contact plates 13 are exposed inwardly of the corresponding seats 42.

The stud-like protrusion 15 upstanding from the center of the circular pedestal 14 formed in the center of the bottom surface of the housing 41 is of a frusto-conical in this example the top surface of which is flush with the top surface of the housing 41.

The movable contact piece 43 comprises a cup-shaped curved section 44 and a pair of marginal regions 45 provided on the opposite sides of the curved section as shown in FIGS. 9A, 9B and 9C, each of the marginal regions 45 having generally triangular contact protuberances 46 extending from the opposite ends thereof. The movable contact piece 43 is formed of a spring material such as phosphor bronze or the like by pressing process.

Like the movable contact piece 28 shown in FIG. 2, the movable contact piece 43 is configured to be brought into contact with four fixed contact plates through the inverting action caused by being pushed. In FIG. 9A, the dotted lines show the positions where the fixed contact plates 13 are disposed. The contact protuberances 46 are provided two for each of the fixed contact plates 13. In other words, the movable contact piece 43 is configured to make contact with each of the fixed contact plates 13 at two points.

The curved section 44 is formed in the center thereof with a positioning hole 31 for locating the movable contact piece in place when it is assembled into the housing. It is to be noted that in this example the marginal regions 45 are slightly folded in the convexly projecting direction of the curved section 44 as shown in FIGS. 9B and 9C. Specifically, the marginal regions 45 are inclined at a small angle in the direction in which the contact protuberances 46 are to bite into the fixed contact plates 13.

The actuator member 47 comprises a plate-like body 48 configured in this example as shown in FIGS. 10A and 10B as if the guide bar 36 and the pair of actuating bars 35 of the actuator member 34 in the prior patent application shown in FIG. 2 were integrally connected together at their roots. The plate-like body 48 is joined at its base end to an operating portion 37.

The plate-like body 48 is thickened in its central section which terminates in a forward end portion having an elliptical notch or slot 49. The opposite side portions of the plate-like body 48 have necked (narrow) portions extending from the operating portion 37 and terminating broadened forward end portions which define flexible portions 51.

The flexible portions 51 have actuating protrusions 38 formed on their undersurfaces adjacent their forward ends 51*a*, and the upper surface edges of the flexible portions 51 at the their forward ends 51*a* are rounded as shown in FIG. 10B to define a radiused surface.

Figure 11D:
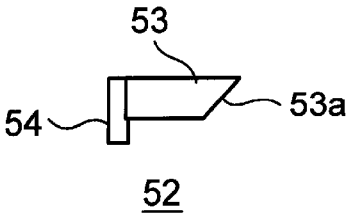
FIG. 11D is a front view of the cam shown in FIG. 11A.

The cam 52 comprises a plate-like engagement portion 53 and a leg portion 54 extending from the engagement portion 53 in the middle at one end thereof as shown in FIGS. 11A–11D. The engagement portion 53 has a notch 55 formed in the middle at the other end thereof to define the opposite side portions separated by the notch 55. The opposite side portions have their end faces beveled to define inclined surfaces 53*a* as shown in FIG. 11D. The opposite side portions of the engagement portion 53 where the inclined surfaces 53*a* are formed are approximately equal in width to the flexible portions 51 of the actuator member 47. The actuator member 47 and the cam 52 are both made of synthetic resin material.

The top lid 24 (see FIG. 7) closing the top of the housing 41 is similar to that as shown in FIG. 2.

How to assemble the components will now be explained with reference to FIGS. 12A, 12B, 13A, 13B, 14A and 14B. It is to be understood that FIGS. 12, 13 and 14 illustrate the sequential steps of the assembling process.

Figure 12A:
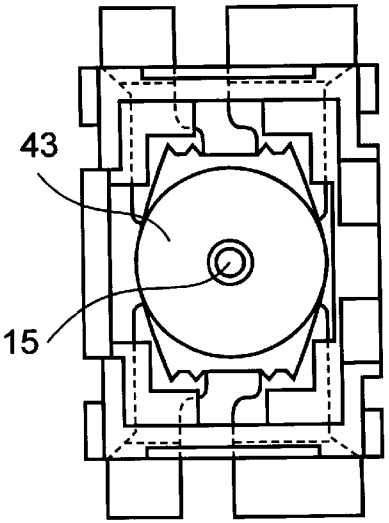
FIG. 12A is a plan view illustrating one step (a) in the procedures of assembling the tact switch shown in FIG. 7.
Figure 12B:
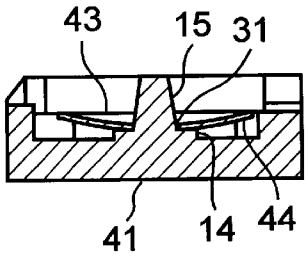
FIG. 12B is a cross-sectional view illustrating the step in FIG. 12A.

(a) First, as illustrated in FIGS. 12A, 12B, the movable contact piece 43 is assembled to the housing 41 from above such that the apex region of the curved section 44 rests on the pedestal 14 with the positioning hole 31 fitted over the protrusion 15 to position the contact piece in place with the curved section projecting downwardly convexly.

Figure 13A:
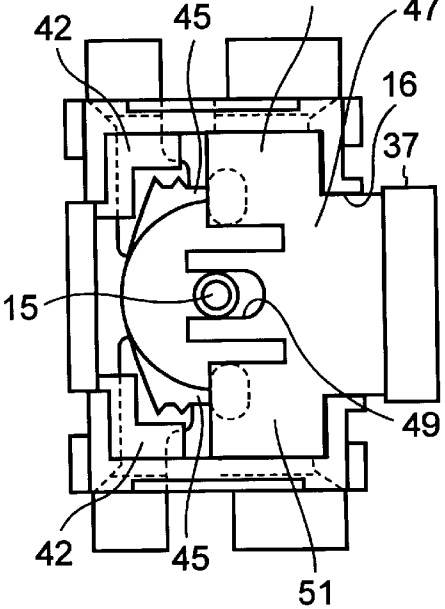
FIG. 13A is a plan view illustrating another step (b) in the procedures of assembling the tact switch.
Figure 13B:
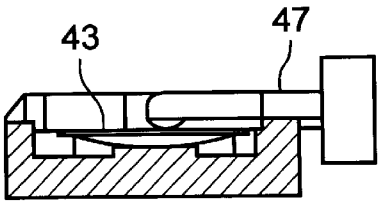
FIG. 13B is a cross-sectional view illustrating the step in FIG. 13A.

(b) Next, as illustrated in FIGS. 13A, 13B, the actuator member 47 is assembled into the housing 41 from above. During this operation of assembly, the pair of flexible portions 51 on one end of the actuator member 47 are located in place on the respective marginal regions 45 of the movable contact piece 43 while the elliptical notch 49 is fitted over the protrusion 15 to position the movable contact piece 43 in place as well as to prevent withdrawal of the contact piece from the protrusion 15. The other end portion of the actuator member 47 extends out of the housing 41 through the notch 16 such that the operating portion 37 is positioned outside of the housing 41.

Figure 14A:
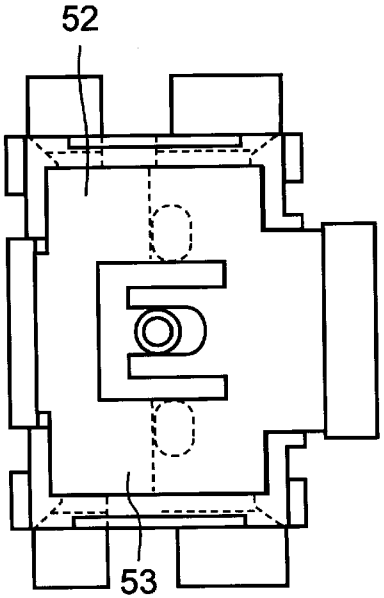
FIG. 14A is a plan view illustrating still another step (c) in the procedures of assembling the tact switch.
Figure 14B:
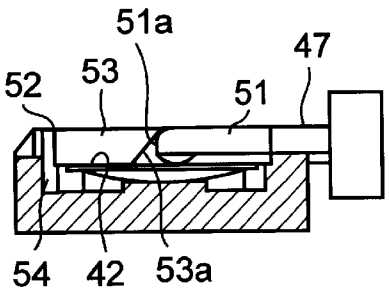
FIG. 14B is a cross-sectional view illustrating the step in FIG. 14A.

(c) Referring to FIGS. 14A, 14B, the next step is to assemble the cam 52 into the housing 41 from above. Specifically, the cam 52 is accommodated in the housing 41 in confronting relation with the actuator member 47 with the leg portion 54 resting on the bottom surface of the housing 41 while the engagement portion 53 is seated on the pair of seats 42. In this state, it is to be appreciated that the two inclined surfaces 53*a* only partly lie over and abut with the forward ends 51*a* of the flexible portions 51 of the actuator member 47 as seen in FIG. 14B.

(d) Finally, the top lid 24 is assembled onto the housing 41 from above. The securement of the top lid 24 to the housing 41 is effected by latching the latch tabs 27 to the engagement lugs 22 of the housing 41 and fitting the engagement flaps 26 into the respective mating engagement recesses 23. This completes the tact switch 56 as shown in FIGS. 7A and 7B.

As discussed above, it is to be understood that the tact switch according to this invention is of such configuration as seen in the illustrated embodiment that it is only required to stack the movable contact piece 43, the actuator member 47, cam 52 and the top lid 24 sequentially from above onto the housing 41 to complete the assembly of the tact switch. It will thus be obvious to those skilled in the art that this construction is easily adapted for automated assembly by the use of an automatic machine.

Further, the tact switch 56 according to this invention may operate in the essentially same manner as the tact switch in the prior patent application shown in FIGS. 1–6. Specifically, when the actuator member 47 is operated to be pushed into the housing 41 in a direction parallel to the bottom surface of the housing, the forward ends 51*a* of the actuator member 47 are progressively depressed downwardly toward the bottom surface of the housing 41 as they are guided along the tapered surfaces 53*a* of the cam 52. As a result, the flexible portions 51 are flexed to press on the marginal regions 45 of the movable contact piece 43 whereupon the curved section 44 is inverted in its convexity-concavity orientation to bring the protruding contacts 46 into the corresponding fixed contact plates 13 to thereby establish conduction between the fixed contact plates 13.

When the pressing operation is released, the movable contact piece 43 is elastically restored to its original curved position whereby the actuator member 47 is pushed out back to its original position to turn the switch off.

While in the embodiment as described above there are two contact protuberances 46 for each of the fixed contact plates 13, it is to be understood that the number of contact protuberances 46 may be one or three or more per one fixed contact plate 13. However, the arrangement of two contact protuberances for each fixed contact plate is most preferable with respect to the contacting reliability. It will also be apparent to those skilled in the art that the locations of the contact protuberances 46 may be appropriately determined depending on the arrangement and number of the opponent fixed contact plates 13.

Figure 15A:
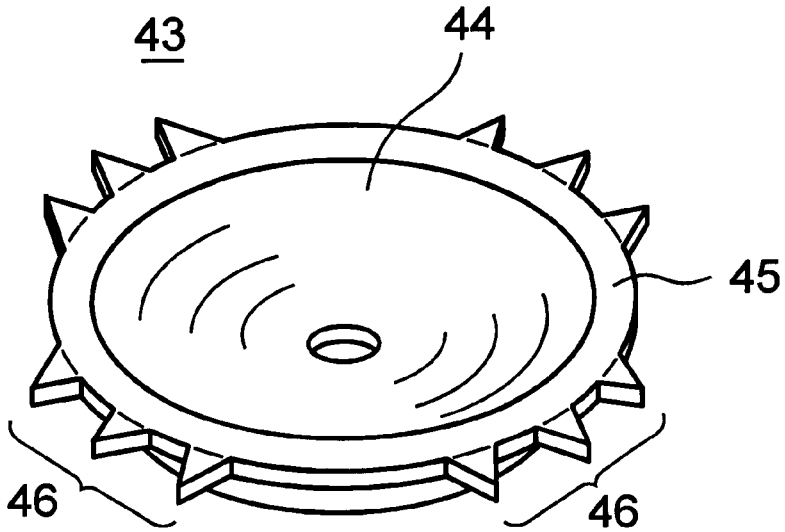
FIG. 15A is a perspective view of another embodiment of the movable contact piece.
Figure 15B:
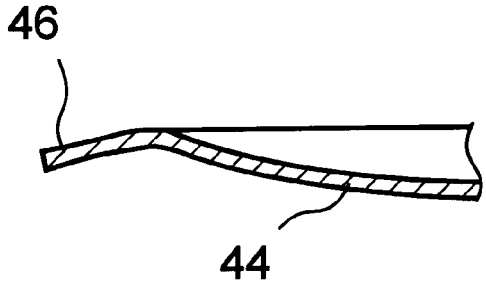
FIG. 15B is an enlarged cross-sectional view a part of the movable contact piece shown in FIG. 15A.

FIGS. 15A and 15B illustrate an alternate form of the movable contact piece 43 in which the movable contact piece is provided with three contact protuberances 46 for each of the fixed contact plates 13 and in which the groups of three contact protuberances 46 are arranged at four locations (front and rear and left and right) around the peripheral region 45 of the curved section 44. It is to be understood that such configuration may be adopted depending on the type of use. Further, it should be noted that each of the contact protuberances 46 is slightly inclined as shown in a fragmentary cross-sectional view in FIG. 15B, as is the case with the movable contact piece 43 as shown in FIGS. 9A, 9B and 9C.

Effects of the Invention

From the foregoing description, it can be seen that according to this invention the inclined surfaces 53*a* for depressing the forward ends 51*a* of the actuator member 47 downwardly toward the bottom surface of the housing to flip the movable contact piece 43 over is defined by the cam 52 which is a component separate from the housing 41 so that all of the components may be assembled simply by stacking them sequentially on the housing 41. It is thus to be appreciated that this construction facilitates the automation of the assembly, and hence allows for providing less expensive tact switches.

In addition, according to this invention, the movable contact piece 43 is provided around its marginal regions 45 with contact protuberances 46 so that upon the curved section 44 being flipped over, the contact protuberances 46 are caused to make point contact with the opponent fixed contact plates 13. It will be appreciated that this arrangement realizes better contact performance, and hence allows for providing a movable contact piece which is superior in contacting stability and reliability.

What is claimed is:

1. A tact switch comprising a box-like housing made of a resin material having an open top, and a plurality of fixed contact plates disposed on a bottom surface thereof;

a movable contact piece comprising a cup-shaped curved section and contact portions provides on marginal regions of the curved section, said curved section normally projecting downwardly convexly and resting on the bottom surface of said housing with said contact portions opposing the fixed contact plates;

an actuator member including a plate-like section disposed in said housing and extending in a direction parallel to the bottom surface of the housing and out of the housing through a notch formed in a side wall of the housing, an operating portion integrally joined to an outer end of said plate-like section extending out of the housing, and a pair of flexible portions integrally joined to said plate-like section on opposite sides thereof, adjacent the forward ends thereof and extending from the plate-like section so as to overlie the marginal regions of said movable contact piece at least two points opposed diametrically of the movable contact piece, said operating portion being pushed into said housing in a direction parallel to said bottom surface in response to a force applied to said actuator member;

a cam positioned forward of an actuating direction of said actuator member within said housing and having an inclined surface for abutting a forward end portion on one end of said actuator member; and a top lid closing said open top of the housing, whereby a force applied to said actuator pushes said forward end portion of the actuator member toward said bottom surface while being guided by said inclined surface, so that said one end of the actuator member flexes pressing down on the marginal regions of said movable contact piece whereby said curved section of the movable contact piece is inverted in its convexity-concavity orientation bringing said contact portions into contact with the fixed contact plates.

2. The tact switch of claim 1 wherein said housing has a positioning pin formed on said bottom surface substantially in the center thereof, said positioning pin being fitted in a positioning hole formed in the center of said movable contact piece.

3. The tact switch of claim 2 wherein the positioning pin extends to the same elevation as the top of a wall of the housing.

4. The tact switch of claim 1 wherein said housing has L-shaped benches formed integrally therewith at interior corners thereof at an elevation intermediate an elevation of said bottom surface and an elevation of said wall, the opposite end portions of said cam and the plate-like section of said actuator member resting on said L-shaped benches at the corners.

5. The tact switch of claim 4 wherein said plate-like section extends towards said positioning pin intermediate said flexible portions and terminates in a forward end having a guide slot for receiving and slidably guiding said pin.

6. The tact switch of any one of claims 1–5 wherein said contact portions of said movable contact piece includes at least two triangular protuberances extending from said marginal portions and opposing said fixed contact plates.

7. A movable contact piece for use with a switch comprising a cup-shaped curved section having marginal regions with contact protuberances, said curved section being configured such that when the marginal regions of the curved section are pressed on, the curved section is flipped over to thereby bring the contact protuberances of the marginal regions into contact with opposed fixed contact plates, and that when the pressing action on the marginal regions is released, the movable contact piece is elastically restored to an initial curved position.

8. The movable contact piece of claim 7 wherein said movable contact piece is provided with two contact protrusions for each of the fixed contact plates.

* * * * *